US006675933B2

(12) United States Patent
Yamaguchi

(10) Patent No.: US 6,675,933 B2
(45) Date of Patent: Jan. 13, 2004

(54) EXHAUST SYSTEM FOR MOTORCYCLE

(75) Inventor: Hideki Yamaguchi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/216,218

(22) Filed: Aug. 12, 2002

(65) Prior Publication Data

US 2003/0079938 A1 May 1, 2003

(30) Foreign Application Priority Data

Aug. 22, 2001 (JP) ..... 2001-251984

(51) Int. Cl.[7] ..... F01N 7/08

(52) U.S. Cl. ..... 181/227; 181/228; 181/232; 181/250

(58) Field of Search ..... 181/227, 228, 181/232, 250

(56) References Cited

U.S. PATENT DOCUMENTS 4,781,264 A * 11/1988 Matsuzaki et al. ..... 180/219
6,026,930 A * 2/2000 Ogisu et al. ..... 181/228
6,247,305 B1 * 6/2001 Bassani ..... 60/312

FOREIGN PATENT DOCUMENTS

JP 59-49313 A 3/1984
JP 362041913 * 2/1987
JP 5-77776 A 3/1993

* cited by examiner

*Primary Examiner*—Shih-Yung Hsieh
(74) *Attorney, Agent, or Firm*—Birch, Stewart, Kolasch & Birch, LLP

(57) ABSTRACT

An exhaust pipe is branched into a right side connecting portion and a connecting portion. The right side connecting portion is connected to a first muffler while the connecting portion is connected to a second muffler through a space under a boundary between a driver's seat and a passenger's seat. It is possible to eliminate the need for reducing the thickness of a portion, corresponding to each of the driver's seat and the passenger's seat, of a cushioning material of the seat and to ensure a sufficient range of vertical movement of a rear wheel. The aforementioned arrangement permits the weight of the exhaust system to be reduced without sacrificing the cushioning characteristic of the seat and the range of vertical movement of the rear wheel.

20 Claims, 8 Drawing Sheets

EXHAUST SYSTEM FOR MOTORCYCLE

CROSS-REFERENCES TO RELATED APPLICATIONS

This nonprovisional application claims priority under 35 U.S.C. § 119(a) on Patent Application No. 2001-251984 filed in Japan on Aug. 22, 2001, the entirety of which is herein incorporated by reference.

BACKGROUND OF THE INVENTION

1. Field of the Invention

The present invention relates to an exhaust system, and more particularly to an exhaust system for a motorcycle capable of reducing the weight of the exhaust system without sacrificing a cushioning characteristic of a seat and a range of vertical movement of a rear wheel.

2. Description of the Background Art

Exhaust systems for motorcycles in which a pair of left and right mufflers are disposed on a rear portion of a vehicular body have been available in the background art. For example, Japanese Patent Laid-open No. Hei 5-77776 entitled "Luggage Box for Motorcycle" and Japanese Patent Laid-open No. Sho 59-49313 entitled "Exhaust System for Motorcycle" describe exemplary exhaust systems of the background art.

Referring to FIGS. 1 and 4 of the 5-77776 ('776) document, a motorcycle in which exhaust pipes 14 and 15 extend rearwardly from an engine 11 and are connected to a collecting chamber 16 is shown. Two exhaust pipes 17 extend upwardly from left and right portions of the collecting chamber 16, and left and right exhaust mufflers 18 are connected to these exhaust pipes 17.

Referring to FIGS. 1 and 2 of the 59-49313 ('313) document, a motorcycle in which an exhaust pipe 14 extends rearwardly from a front cylinder 7a of an engine 7 is shown. A muffler 15 is connected to the exhaust pipe 14, an exhaust pipe 16 extends rearwardly from a rear cylinder 7b of the engine 7 and a muffler 17 is connected to the exhaust pipe 16 via an extension pipe 18. A front portion of the muffler 15 is in communication with a front portion of the muffler 17 by means of a communication pipe 23.

The present inventor has determined that the systems of the background art suffer from the following problems. If the exhaust pipes 17 described in the '776 document are in communication with each other at positions immediately before the exhaust mufflers 18 by using a communication pipe, e.g., the communication pipe 23 described in the '336 document, then the exhaust pipes 17 can be collected into one pipe and the weight of the exhaust system can be reduced. However, to dispose the communication pipe under a seat 9 at a position immediately before the exhaust pipes 18, it is required to reduce the thickness of a cushioning material of the seat 9. Accordingly, a cushioning characteristic of the seat 9 is degraded and riding comfort is sacrificed.

It also may be possible to lower the position of the communication pipe along with the positions of the exhaust pipes 17 and the exhaust mufflers 18 to cope with this inconvenience, e.g., to eliminate the need for thinning the cushion material of the seat 9. However, a vertical movement of a rear wheel 7 must be reduced in order to prevent interference of the rear wheel 7 with the exhaust pipes 17, the exhaust mufflers 18, and the communication pipe. As a result, the integrity and operability of the rear suspension is sacrificed.

SUMMARY OF THE INVENTION

The present invention overcomes the shortcomings associated with the background art and achieves other advantages not realized by the background art.

An object of the present invention is to provide an improved exhaust system structure.

An object of the present invention is to provide a motorcycle exhaust system having a reduced weight without sacrificing a cushioning characteristic of a seat and a range of vertical movement of a rear wheel.

One or more of these and other objects are accomplished by an exhaust system for a motorcycle having a tandem seat, the exhaust system comprising an exhaust pipe extending rearwardly from an engine of the motorcycle; a pair of first and second mufflers connecting with a rear end of the exhaust pipe; a first branch pipe and a second branch pipe forming the rear end of the exhaust pipe; and a recess formed beneath a driver's seat and a passenger's seat in the tandem seat; wherein the first branch pipe is connected to the first muffler and the second branch pipe is connected to the second muffler.

One or more of these and other objects are accomplished by the combination of a motorcycle having an engine, a longitudinal centerline, a rear wheel, a rear cowl, a tandem seat, and a body frame and an exhaust system, the exhaust system comprising an exhaust pipe extending rearwardly from an engine of the motorcycle; a pair of left and right mufflers connecting with a rear end of the exhaust pipe; a first branch pipe and a second branch pipe forming the rear end of the exhaust pipe; and a recess formed beneath a driver's seat and a passenger's seat in the tandem seat; wherein the first branch pipe is connected to the left muffler and the second branch pipe is connected to the right muffler through the recess.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
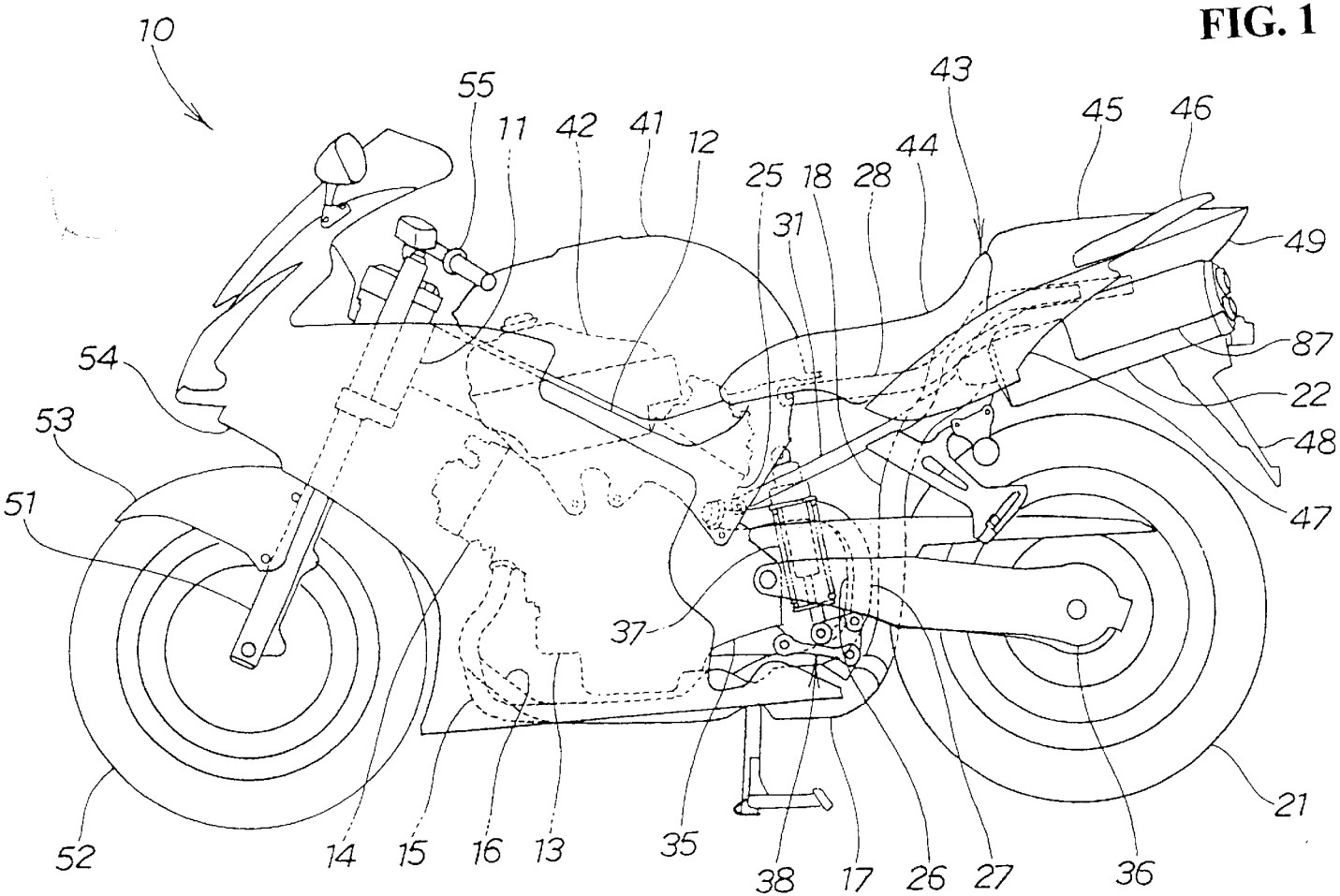
FIG. 1 is a side view of a motorcycle having an exhaust system according to the present invention.
Figure 2:
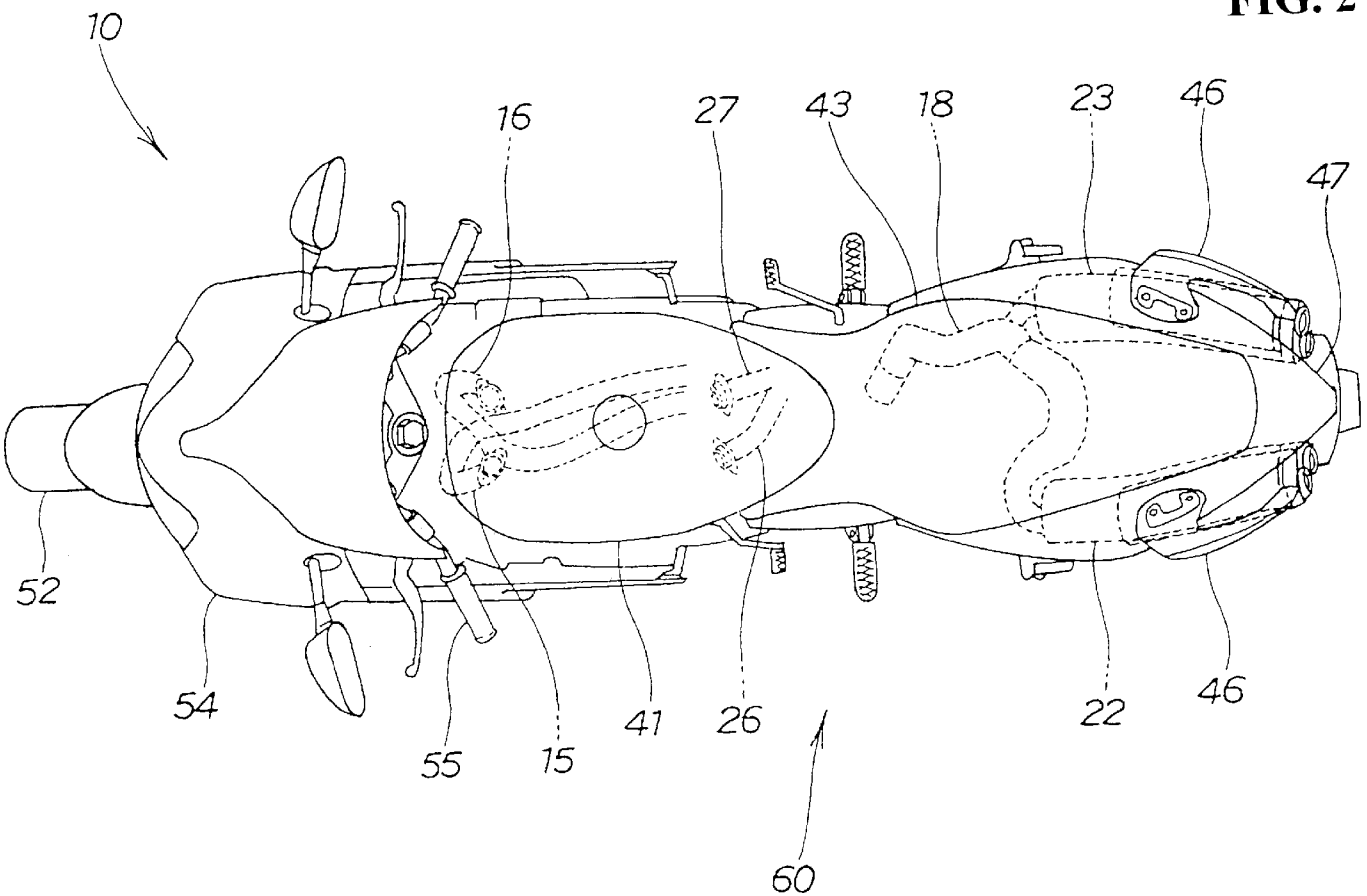
FIG. 2 is a plan view of the motorcycle shown in FIG. 1.
Figure 3:
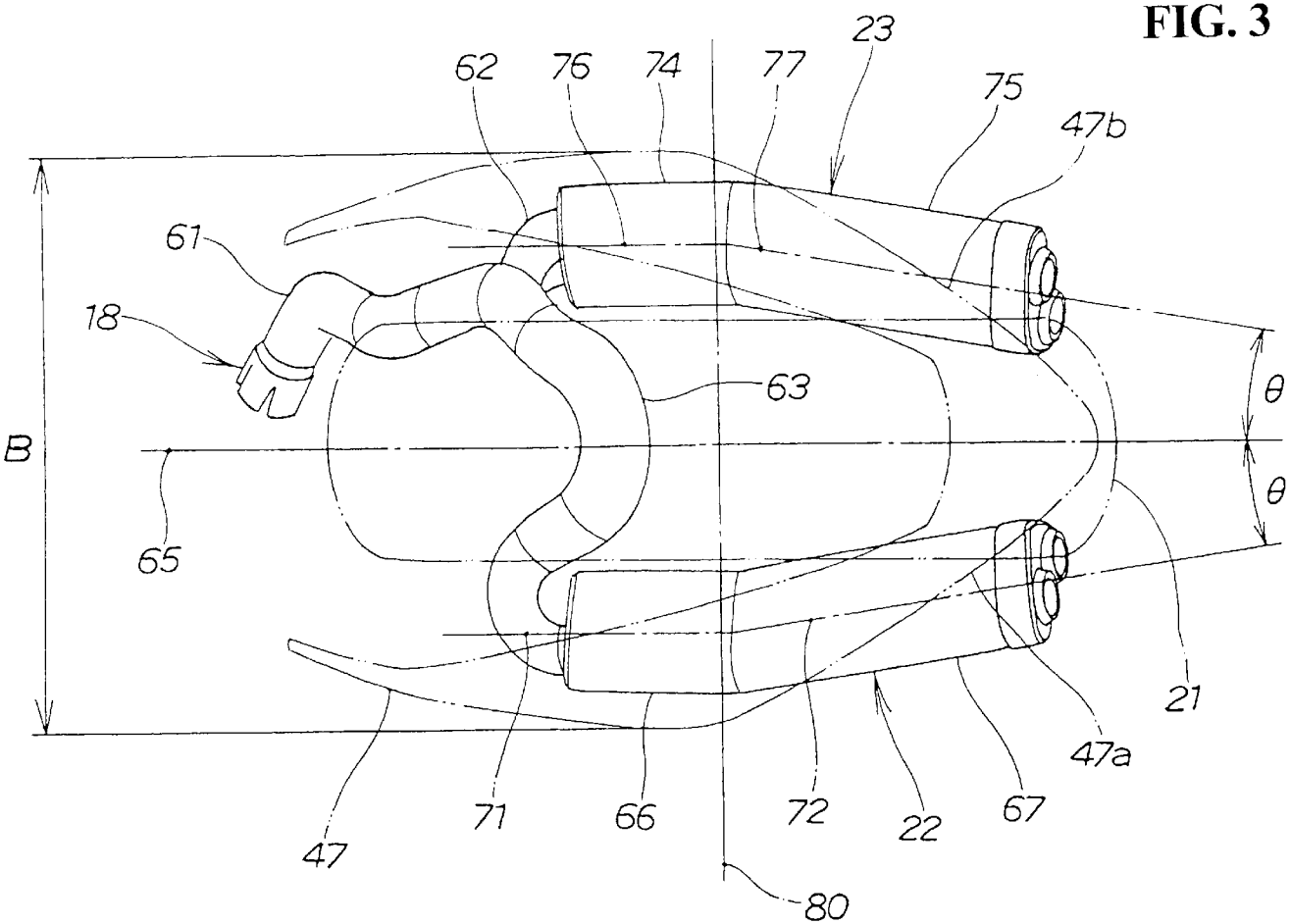
FIG. 3 is a plan view of a rear portion of a motorcycle body including the exhaust system of the present invention.
Figure 4:
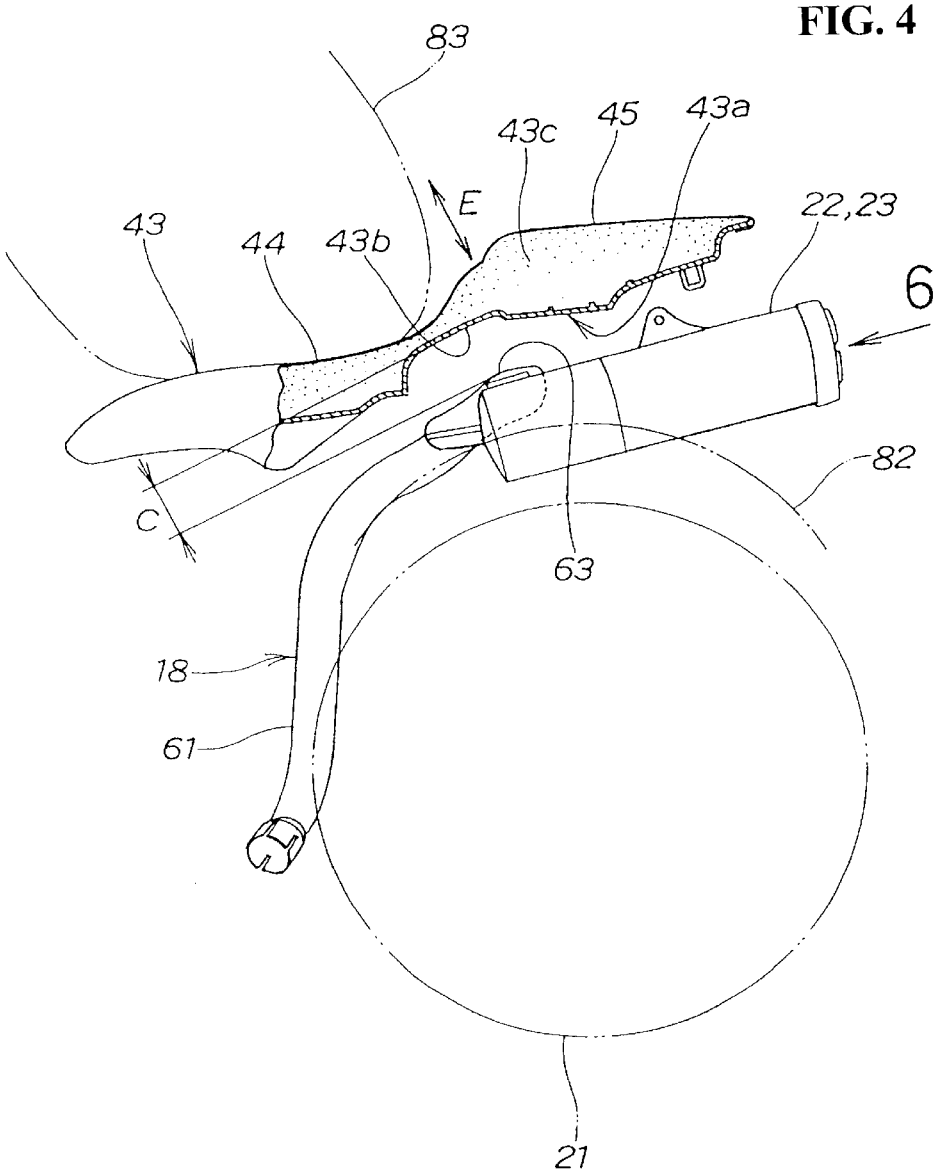
FIG. 4 is a side view of the exhaust system of the present invention.
Figure 5:
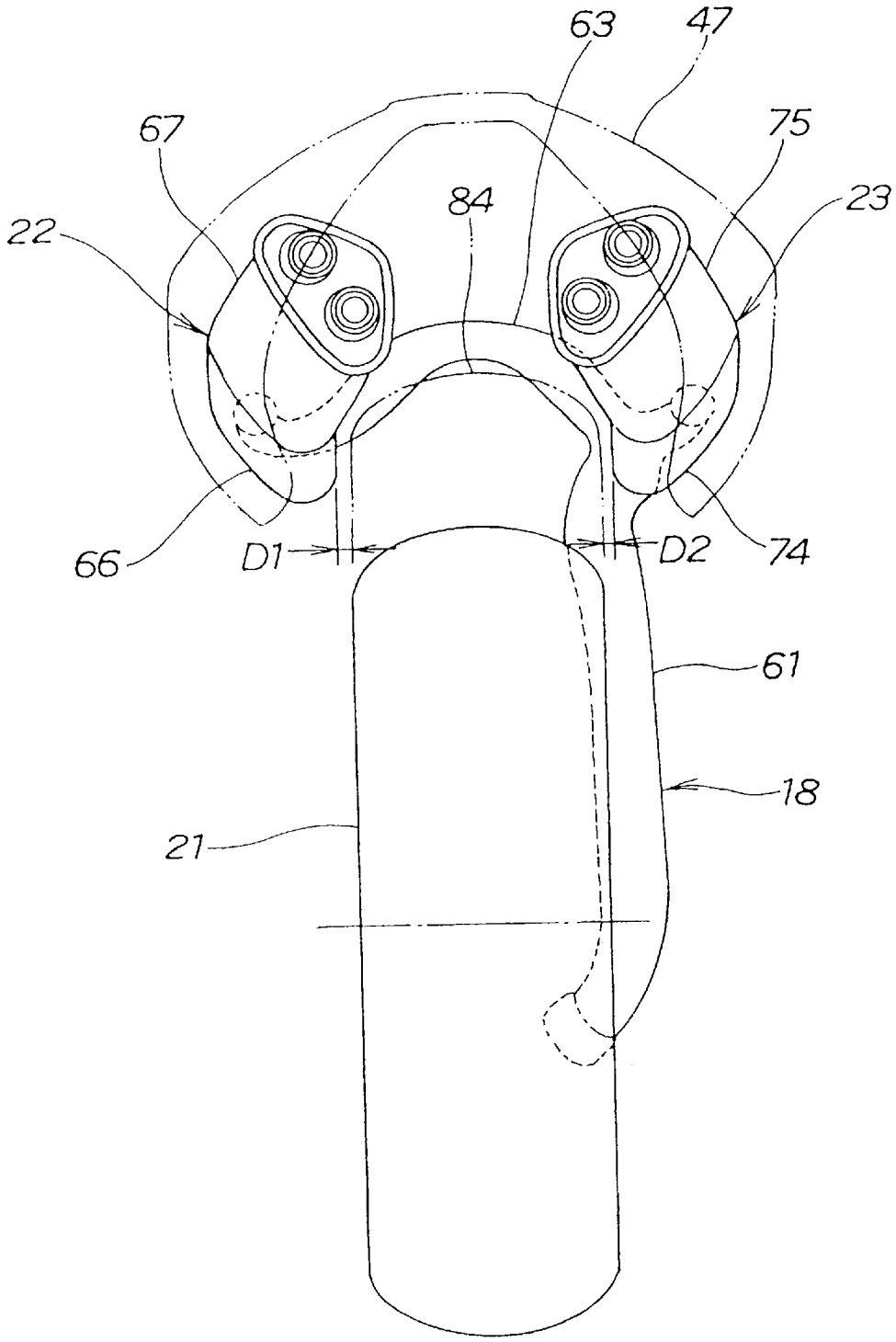
FIG. 5 is a rear view of the exhaust system of the present invention.
Figure 6A:
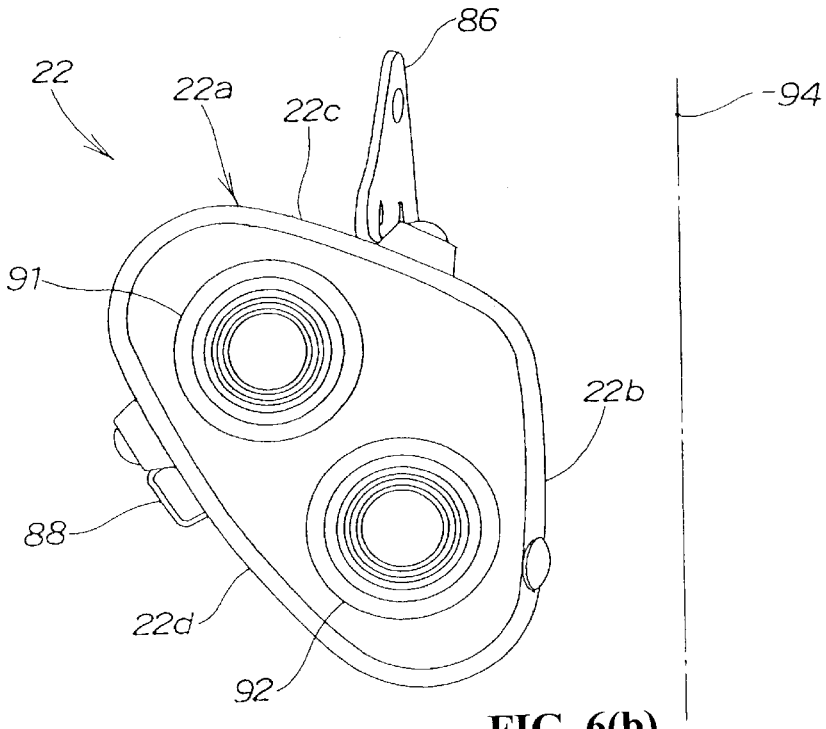
FIGS. 6(*a*) and 6(*b*) are views of portions of the exhaust system of the present invention.
Figure 6B:
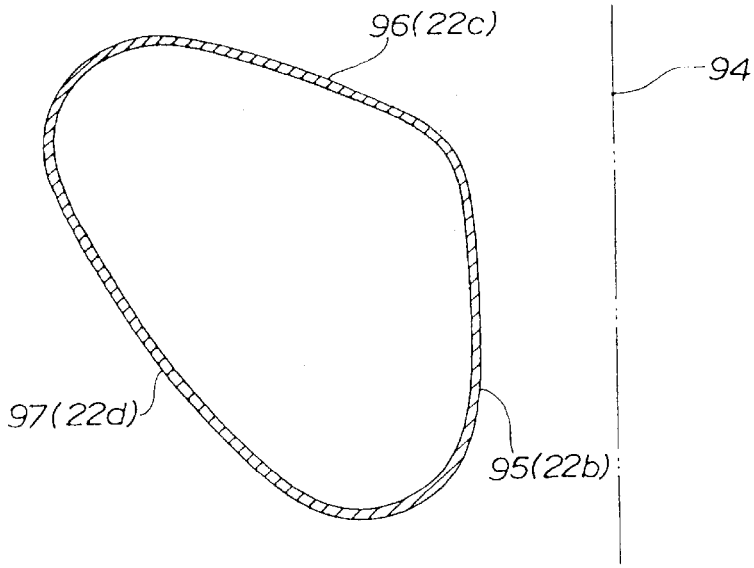
Figure 7:
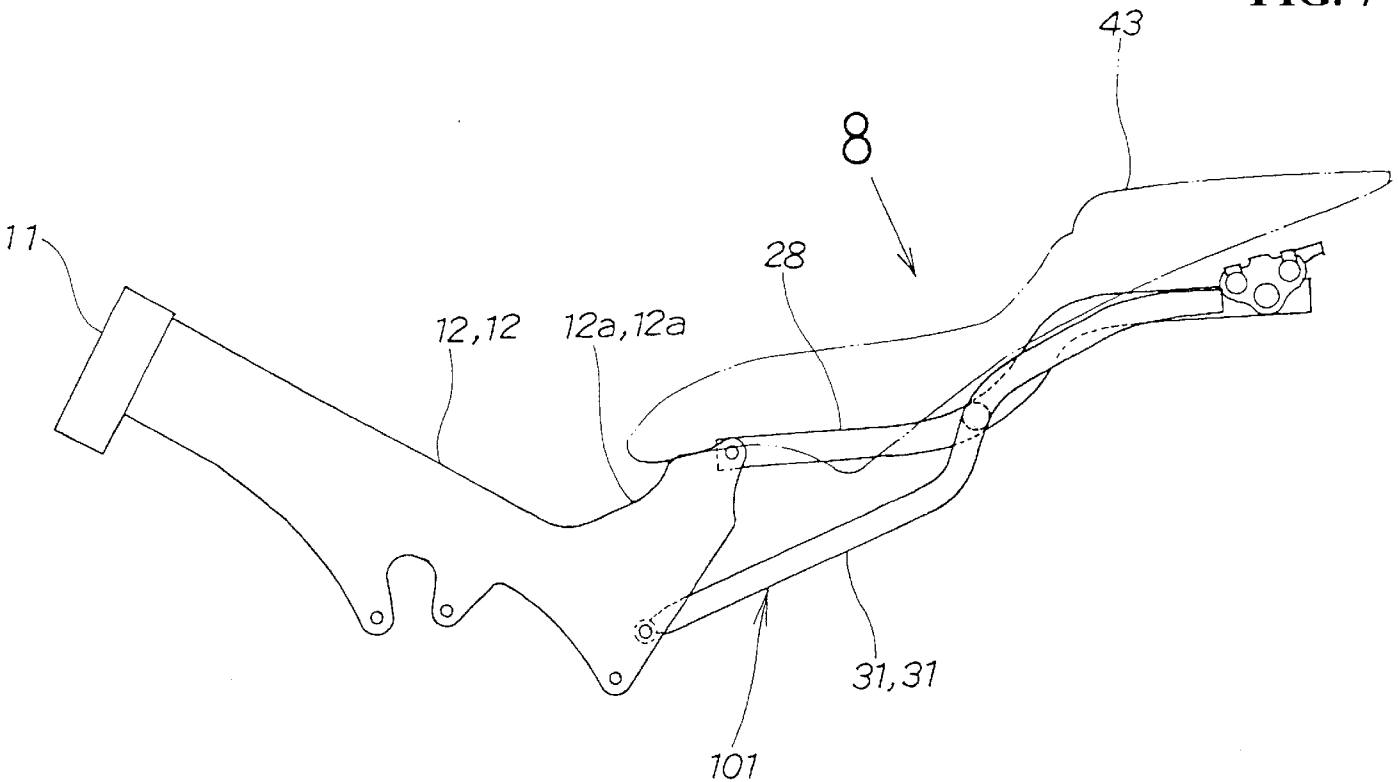
FIG. 7 is a side view of a portion of the motorcycle according to the present invention.
Figure 8:
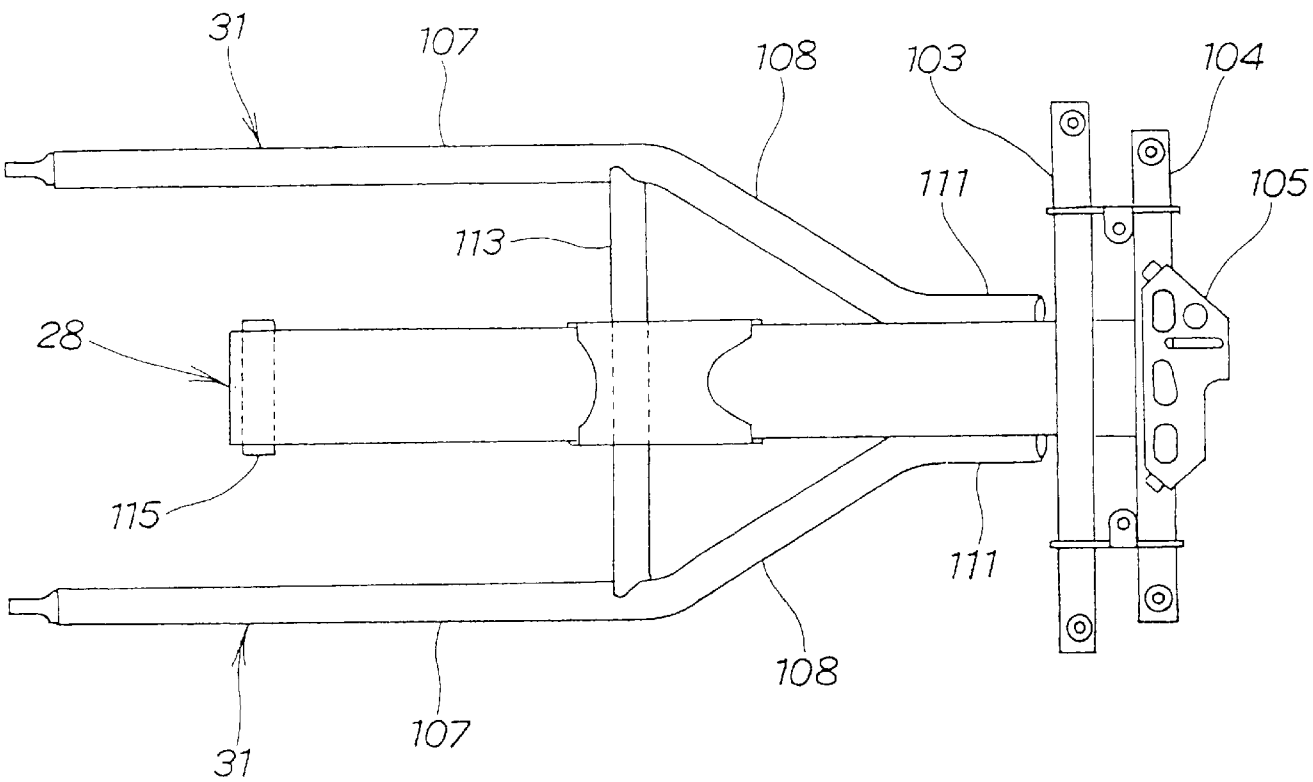
FIG. 8 is a view taken along an arrow 8 in FIG. 7.

The present invention will hereinafter be described with reference to the accompanying drawings. FIG. 1 is a side view of a motorcycle having an exhaust system according to the present invention. FIG. 2 is a plan view of the motorcycle shown in FIG. 1. FIG. 3 is a plan view of a rear portion of a motorcycle body including the exhaust system of the present invention. FIG. 4 is a side view of the exhaust system of the present invention. FIG. 5 is a rear view of the exhaust system of the present invention. FIGS. 6(*a*) and 6(*b*) are views of portions of the exhaust system of the present invention. FIG. 7 is a side view of a portion of the motorcycle according to the present invention. FIG. 8 is a view taken along an arrow 8 in FIG. 7.

As seen in FIG. 1, a motorcycle 10 includes two main frames 12 (the main frame 12 on the depth side is not shown) extending rearwardly and slightly downwardly from a head pipe 11. A V-shaped engine 13 is mounted to lower portions of these main frames 12. Exhaust pipes 15 and 16 extend rearwardly from a front side cylinder head 14 of the engine 13, and are collected into one pipe that is connected to a collecting portion 17. An exhaust pipe 18 is raised from the collecting portion 17 and is connected to left and right mufflers 22 and 23 (the muffler 23 on the depth side is not shown) disposed over a rear wheel 21. Exhaust pipes 26 and 27 extend rearwardly from a rear side cylinder head 25 of the engine 13, and are similarly collected into a single pipe that is connected to the collecting portion 17.

A seat rail 28 extends rearwardly, and obliquely upward from upper rear portions of the main frames 12. Two sub-pipes 31 (the sub-pipe 31 on the depth side is not shown) extend rearwardly, and obliquely upward from lower rear portions of the main frames 12. Intermediate portions and rear ends of the sub-pipes 31 are mounted to the seat rail 28.

A mission case 35 is integrally provided on a rear portion of the engine 13 and a swing arm 36 is swingably mounted to the mission case 35. A rear cushion unit 37 with its lower end connected to both a lower front portion of the swing arm 36 and the mission case 35 via a link system 38 and its upper end connected to rear portions of the main frames 12 is also provided as shown. A fuel tank 41 is mounted on upper portions of the main frames 12 and an intake box 42 is provided on a lower portion of the fuel tank 41. A tandem seat 43 is mounted on the seat rail 28, e.g., wherein a driver's seat 44 and a passenger's seat is provided 45. A pair of passenger's handles 46 (the passenger's handle 46 on the depth side is not shown) and a rear cowl 47 for covering the mufflers 22 and 23 is also provided. A rear fender 48, tail lamp 49, a front fork 51, a front wheel 52, a front fender 53, a front cowl 54, and a handlebar 55 are also provided as shown in the accompanying figures.

FIG. 2 is a plan view of a motorcycle according to the present invention. The exhaust pipes 15 and 16 extend rearwardly from respective front side cylinders of the engine 13 (see FIG. 1). The exhaust pipes 26 and 27 extend rearwardly from respective rear side cylinders of the engine 13, and the exhaust pipe 18 is connected to the left and right mufflers 22 and 23.

The passenger's handles 46 project sideways with respect to the vehicular body from the mufflers 22 and 23. Accordingly, if some external force is applied to the vehicular body from the sides of the vehicular body, the external force is prevented from being directly applied to the mufflers 22 and 23 by the passenger's handles 46. The exhaust pipes 15 and 16, the exhaust pipes 26 and 27, the collecting portion 17 (see FIG. 1), the exhaust pipe 18, and the mufflers 22 and 23 form an exhaust system 60.

FIG. 3 is a plan view of a rear portion of the motorcycle body illustrating the exhaust system of the present invention. The exhaust pipe 18 includes an exhaust pipe front portion 61 provided on a front side of the exhaust pipe 18, a right side connecting portion 62 extending from the exhaust pipe front portion 61 to the right side muffler 23, and a connecting portion 63 for connecting the right side connecting portion 62 to the left side muffler 22.

The muffler 22 includes a parallel portion 66 extending in parallel with respect to a longitudinal center axis 65 of the vehicular body of the motorcycle 10 (see FIG. 1), and a tilt portion 67 extending rearwardly from the parallel portion 65 in such a manner as to become gradually closer to the longitudinal center axis 65. A longitudinal center axis 71 of the parallel portion 66 extends in parallel to the longitudinal axis 65 of the vehicular body. A longitudinal center axis 72 of the tilt portion 67 includes an angle θ with respect to the longitudinal center axis 65 of the vehicular body.

The muffler 23 is symmetric with respect to the opposing muffler 22 about the longitudinal center axis 65 of the vehicular body. The mufflers 23 include a parallel portion 74 and a tilt portion 75. A longitudinal center axis 76 of the parallel portion 74 and a longitudinal center axis 77 of the tilt portion 75 are also provided as shown. The longitudinal center axis 76 extends in parallel to the longitudinal center axis 65 and the longitudinal center axis 77 is tilted by an angle θ with respect to the longitudinal center axis 65.

The parallel portions 66 and 74 are disposed over an axle 80 of the rear wheel 21, and do not interfere with an upper portion of the rear wheel 21 when the rear wheel 21 is raised with respect to the vehicular body. The rear cowl 47 is disposed under side portions and a rear portion of a tandem seat 43 (see FIG. 1). The rear cowl 47 has a width B between side positions of the parallel portions 66 and 74 of the mufflers 22 and 23, wherein the width B is equivalent to the largest width of the vehicular body. Edge portions 47*a* and 47*b* of the rear cowl 47, e.g., located behind the portions having the width B of the rear cowl 47, are tilted approximately along the tilt portions 67 and 75 of the rear side of the vehicular body.

FIG. 4 is a side view illustrating the exhaust system of the present invention. As shown in this figure, the connecting portion 63 (see FIG. 3) for connecting the left and right mufflers 22 and 23 (the right side muffler 23 is not shown) to each other is located under the tandem seat 43 at a boundary between the driver's seat 44 and the passenger's seat 45 of the tandem seat 43. A position of the rear wheel 21 during a state in which the wheel is raised with respect to the vehicular body, e.g., the most raised position of the rear wheel 21 is designated by numeral 82 in FIG. 4.

The tandem seat 43 has a bottom plate 43*a* at its bottom portion. The bottom plate 43*a* has a recess 43*b* at the above-described boundary between the driver's seat 44 and the passenger's seat 45. The connecting portion 63 is positioned with a specific clearance C put between the bottom of the recess 43*b* and the connecting portion 63. As shown in the figure, the mufflers 22 and 23 are located behind the driver's seat 44, e.g., behind a driver 83 depicted as sitting astride the motorcycle 10. Since the connecting portion 63 is disposed under the tandem seat 43 at the boundary between the driver's seat 44 and the passenger's seat 45, the tandem seat 43 can be separated apart from the connecting portion 63 by the specific clearance C. Accordingly, sufficient movement of the rear wheel 21 can be ensured when the rear wheel 21 is raised with respect to the vehicular body. A sufficient thickness of the driver's seat 44 and the passenger's seat 45, e.g., of a cushioning material 43*c*, can be maintained to ensure the cushioning characteristic of each of the driver's seat 44 and the passenger's seat 45.

FIG. 5 is a rear view illustrating the exhaust system for a motorcycle. The rear wheel 21 is shown raised up to the most raised position 84 and is viewed from the rear side of the vehicular body. The parallel portion 66 of the muffler 22 and the parallel portion 74 of the muffler 23 are separated apart from side surfaces of the rear wheel 21 by distances D1 and D2 (which may be equal to each other, e.g, D1=D2), respectively. Both the side portions of the rear cowl 47 are disposed so as to cover side surfaces of the mufflers 22 and 23.

From the viewpoint of reducing the weight of the exhaust system, the system of the present invention is configured such that only one exhaust pipe front portion 61 of the exhaust pipe 18 is raised in front of the rear wheel. In contrast to the systems of the background art, e.g., wherein two exhaust pipes are in raised positions in front of the rear wheel, the weight of the exhaust system 60 can be reduced with the present invention (see FIG. 2).

In order to increase the range of vertical movement of the rear wheel 21, as well as the thickness of the cushioning material 43*c* of the tandem seat 43 (see FIG. 4), a central portion of the connecting portion 63 and its vicinity is flattened or crimped. Referring again to FIG. 4, the connecting portion 63 is flattened in a direction where the connecting portion 63 is separated apart from the bottom plate 43*a* of the tandem seat 43 by the specific clearance C. A diameter of the connecting portion 63 in a direction shown by an arrow E in FIG. 4 is set to be smaller than a diameter of the connecting portion 63 in a direction perpendicular to the direction E.

FIGS. 6(*a*) and 6(*b*) are views illustrating the muffler 22 and portions of the exhaust system of the present invention. FIG. 6(*a*) is a view of the muffler 22 as seen along an arrow 6 of FIG. 4. FIG. 6(*b*) is a vertical sectional view of the muffler 22. With reference to FIG. 6(*a*), the muffler 22 is formed into a shape different from a regular circular shape, e.g., a shape similar to the shape of an isosceles triangle shape. The muffler 22 includes an outer wall 22*a* having a shape similar to an isosceles triangle shape and the outer wall 22*a* includes an inner wall portion 22*b*, an upper side tilt wall portion 22*c*, and an outer side tilt wall portion 22*d*.

A mounting portion 86 mounted to the seat rail (see FIG. 1) is provided on the upper side tilt wall portion 22*c* and a heat shield plate mounting portion 88 to which a heat shield plate 87 (see FIG. 1) is mounted is provided on the outer side tilt wall portion 22*d*. Tail pipes 91, 92 are also shown in the accompanying figures. FIG. 6(*b*) shows a vertical, triangular cross-section of the muffler 22 (see FIG. 6(*a*) for clarifying the structure of the muffler 22.

In FIG. 6(*b*), a first side 95 of the triangular shape, equivalent to the cross-section of the inner wall portion 22*b*, extends in parallel to a vertical line 94. A second side 96 of the triangular shape, equivalent to the cross-section of the upper side tilt wall portion 22*c*, extends sideways of the vehicular body from an upper end of the first side 95, and a third side 97, equivalent to the cross-section of the outer side tilt wall portion 22*d*, extends so as to connect a leading end of the second side 96 to a lower end of the first side 95. It is to be noted that the structure of the muffler 23 of FIG. 5 is the same as that of the muffler 22 described with reference to FIGS. 6(*a*) and 6(*b*).

FIG. 7 is a side view of a portion of the motorcycle of the present invention. Two upper projecting portions 12*a* are provided on rear portions of the main frames 12. A front end of the seat rail 28 formed into an approximately S-shape is mounted to the upper projecting portions 12*a*. Front ends of the sub-pipes 31, each of which is formed into an approximately S-shape, are mounted to lower rear portions of the main frames 12. Intermediate portions of the sub-pipes 31 are mounted to an intermediate portion of the seat rail 28 and rear ends of the sub-pipes 31 are mounted to a rear end portion of the seat rail 28.

Since the seat rail 28 is mounted to the higher portions of the main frames 12 and the sub-pipes 31 are mounted to the lower portions of the main frames 12, a triangular frame 101 can be formed by the main frames 12, the seat rail 28, and the sub-pipes 31. This triangular shaped frame enhances the rigidity of a front half portion of the seat rail 28. Since the intermediate portion of the seat rail 28 is connected to the intermediate portions of the sub-pipes 31 and the rear end portion of the seat rail 28 is connected to the rear ends of the sub-pipes 31, a rear half portion of the seat rail 28 can be also enhanced. Accordingly, the weight of the tandem seat 43 on which a driver and a passenger are sitting, the weight of the mufflers 22 and 23 with the enlarged volumes, and the weight of other parts can be sufficiently supported by the seat rail 28 configured as described above.

FIG. 8 is a view taken along an arrow 8 in FIG. 7. FIG. 8 shows the seat rail and the sub-pipes. The seat rail 28 is a member having a rectangular cross-section extending straight to the rear side of the vehicular body. A rear end portion of the seat rail 28 has three brackets 103, 104, and 105. The passenger's handles 46 (see FIG. 2) are mounted to the brackets 103, 104, and 105 via the mufflers 22 and 23 (see FIG. 5) and the rear cowl 47 (see FIG. 5) on which a tail lamp (not shown) has been mounted.

FIG. 8 also shows a mounting state of the sub-pipes 31. Each of the sub-pipes 31 includes a parallel pipe portion 107 extending in parallel to the seat rail 28, a tilt pipe portion 108 extending from the parallel pipe portion 107 in such a manner as to be close to the seat rail 28 side, and a mounting pipe portion 111 extending from the tilt pipe portion 108 rearward. The mounting pipe portions 111 of the sub-pipes 31 are mounted to side surfaces of the seat rail 28, and rear ends of the parallel pipe portions 107 of the sub-pipes 31 are mounted to a cross pipe 113 passing through the seat rail 28. In the figure, reference numeral 115 denotes a main frame mounting portion for mounting the seat rail 28 to the main frames 12 (see FIG. 7).

As described with reference to FIGS. 1, 3, and 4, the motorcycle 10 of the present invention includes the exhaust pipe 18 to which the exhaust pipes 15 and 16, and 26 and 27 extending rearwardly from the engine 13 are connected via the connecting pipe 17. The exhaust pipe 18 is connected to the pair of left and right mufflers 22 and 23, wherein the exhaust pipe 18 is branched, on the way to the mufflers 22 and 23, into the right side connecting portion 62 as a first branch pipe and the connecting portion 63 as a second branch pipe. The right side connecting portion 62 is connected to one muffler 23 while the connecting portion 63 is connected to the other muffler 22 through a space under a boundary between the driver's seat 44 and the passenger's seat 45.

The connection portion 63 is connected to the other muffler 22 through a space under the boundary between the driver's seat 44 and the passenger's seat 45. Since the recess 43*b* allowing the connecting portion 63 to reside therein is formed in the bottom plate 43*a* of the tandem seat 43 at the boundary between the driver's seat 44 and the passenger's seat 45, the connecting portion 63 can be made closer to the tandem seat 43 side. As a result, it is possible to ensure a sufficient thickness of a portion, corresponding to each of the driver's seat 44 and the passenger's seat 45, of the cushioning material 43*c*. In addition, it is possible to ensure a sufficient range of vertical movement of the rear wheel 21. The weight of the exhaust system 60 (see FIG. 2) can be reduced by collecting the exhaust pipes into one exhaust pipe, e.g., the exhaust pipe 18 having the exhaust pipe front portion 61 in front of the mufflers 22 and 23. This permits the aforementioned advantageous effects without sacrificing the cushioning characteristic of the tandem seat 43 and the vertical movement amount of the rear wheel 21.

Referring to FIG. 4, if the connecting portion 63 is disposed at a position intermediate of the height of the exhaust pipe front portion 61 of the exhaust pipe 18, it is possible to eliminate the occurrence of interference between the connecting portion 63 and the seat 43 and between the connecting portion 63 and the rear wheel 21. However, in this case, there arises an inconvenience that the connecting portion 63 becomes longer or the connecting portion 63 must be connected to the mufflers 22 and 23 via two pipes, thereby degrading one of the aforementioned effects of reducing the weight of the exhaust system 60. In addition, according to the present invention, by flattening the connecting pipe along the back surface of the seat without changing its cross-section, the connecting portion can be made still closer to the back surface of the seat, to thereby further increase the vertical movement amount of the rear wheel.

The present invention configured as described above has the following effects. According to the exhaust system for a motorcycle described above, the exhaust pipe is branched, on the way to the mufflers, into a first branch pipe and a second branch pipe. The first branch pipe is connected to one of the mufflers, and the second branch pipe is connected to the other of the mufflers through a space under a boundary between a driver's seat and a passenger's seat. As a result, it is possible to eliminate the need for reducing the thickness of a portion, corresponding to each of the driver's seat and the passenger's seat, of a cushioning material of the seat. This ensures a sufficient vertical movement amount of the rear wheel. The weight of the exhaust system can also be reduced without sacrificing the cushioning characteristic of the seat and the range of vertical movement of the rear wheel.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust system for a motorcycle having a tandem seat, said exhaust system comprising:

an exhaust pipe extending rearwardly from an engine of the motorcycle;

a pair of first and second mufflers connecting with a rear end of the exhaust pipe;

a first branch pipe and a second branch pipe forming the rear end of the exhaust pipe; and a recess formed beneath a driver's seat and a passenger's seat in the tandem seat; wherein said first branch pipe is connected to said first muffler and said second branch pipe is connected to said second muffler.

2. The exhaust system according to claim 1, further comprising a connecting portion connecting said first and second mufflers, said connecting portion being located beneath the recess of the tandem seat.

3. The exhaust system according to claim 1, wherein said tandem seat includes a bottom plate at a bottom portion thereof, said recess being formed in the bottom plate.

4. The exhaust system according to claim 3, wherein said connecting portion is provided with a specific clearance between the recess of the bottom plate and the connecting portion.

5. The exhaust system according to claim 3, further comprising a flattened central portion of the connecting portion.

6. The exhaust system according to claim 5, wherein said connecting portion is provided with a specific clearance between the recess of the bottom plate and the flattened central portion.

7. The exhaust system according to claim 6, said first and second mufflers having triangular shaped cross-section, wherein each of said mufflers includes an outer wall with an inner wall portion, an upper side tilt wall portion, and an outer side tilt wall portion.

8. The exhaust system according to claim 7, further comprising a mounting portion mounted to a seat rail provided on the upper side tilt wall portion and a heat shield plate mounting portion having a heat shield plate mounted on the outer side tilt wall portion.

9. The exhaust system according to claim 1, wherein said first and second mufflers are positioned rearward of said driver's seat and beneath said passenger's seat.

10. The exhaust system according to claim 1, said first and second mufflers having triangular shaped cross-section, wherein each of said mufflers includes an outer wall with an inner wall portion, an upper side tilt wall portion, and an outer side tilt wall portion.

11. The exhaust system according to claim 10, further comprising a mounting portion mounted to a seat rail provided on the upper side tilt wall portion and a heat shield plate mounting portion having a heat shield plate mounted on the outer side tilt wall portion.

12. In combination, a motorcycle having an engine, a longitudinal centerline, a rear wheel, a rear cowl, a tandem seat, and a body frame and an exhaust system, said exhaust system comprising:

an exhaust pipe extending rearwardly from an engine of the motorcycle;

a pair of left and right mufflers connecting with a rear end of the exhaust pipe;

a first branch pipe and a second branch pipe forming the rear end of the exhaust pipe; and a recess formed beneath a driver's seat and a passenger's seat in the tandem seat; wherein said first branch pipe is connected to said left muffler and said second branch pipe is connected to said right muffler through the recess.

13. The exhaust system according to claim 12, further comprising a connecting portion connecting said first and second mufflers, said connecting portion being located beneath the recess of the tandem seat.

14. The exhaust system according to claim 12, wherein said tandem seat includes a bottom plate at a bottom portion thereof, said recess being formed in the bottom plate.

15. The exhaust system according to claim 12, wherein said first and second mufflers are positioned rearward of said driver's seat and beneath said passenger's seat.

16. The exhaust system according to claim 12, further comprising a flattened central portion of the connecting portion.

17. The exhaust system according to claim 16, wherein said connecting portion is provided with a specific clearance between the recess of the bottom plate and the flattened central portion.

18. The exhaust system according to claim 12, said first and second mufflers having triangular shaped cross-sections, wherein each of said mufflers includes an outer wall with an inner wall portion, an upper side tilt wall portion, and an outer side tilt wall portion.

19. The exhaust system according to claim 18, further comprising a mounting portion mounted to a seat rail provided on the upper side tilt wall portion and a heat shield plate mounting portion having a heat shield plate mounted on the outer side tilt wall portion.

20. The exhaust system according to claim 12, wherein said first and second mufflers are positioned rearward of said driver's seat and between said passenger's seat and said rear cowl.

* * * * *